US006106174A

United States Patent [19]

Shen

[11] Patent Number: 6,106,174

[45] Date of Patent: Aug. 22, 2000

[54] PRINTING MACHINE FOR PLASTIC TILE WITH FEEDING CORRECTION DEVICE

[75] Inventor: Chi-Feng Shen, Tainan Hsien, Taiwan

[73] Assignee: Win Ton Plastics Industry Co., Ltd., Tainan Hsien, Taiwan

[21] Appl. No.: 09/345,970

[22] Filed: Jul. 1, 1999

[51] Int. Cl.[7] ..... B41J 11/42

[52] U.S. Cl. ..... 400/583; 400/619

[58] Field of Search ..... 400/583.1, 583, 400/579, 619

[56] References Cited

U.S. PATENT DOCUMENTS

| | | | |
|---|---|---|---|
| 3,495,528 | 2/1970 | Pitt | 400/583 |
| 4,900,174 | 2/1990 | Didiergeorge | 400/583 |
| 5,098,507 | 3/1992 | Mao | 156/351 |
| 5,122,212 | 6/1992 | Ferguson et al. | 156/209 |
| 5,915,864 | 6/1999 | Austin et al. | 400/579 |
| 5,929,894 | 7/1999 | Kikuchi | 400/583 |

FOREIGN PATENT DOCUMENTS

| | | | |
|---|---|---|---|
| 0101382 | 6/1984 | Japan | 400/579 |
| 405031978 | 2/1993 | Japan | 400/579 |
| 2195020 | 3/1988 | United Kingdom | 400/579 |

*Primary Examiner*—John S. Hilten
*Assistant Examiner*—Anthony H. Nguyen
*Attorney, Agent, or Firm*—Rosenberg, Klein & Lee

[57] ABSTRACT

A printing machine for plastic tile with a feeding correction device comprises a central electric sensing eye disposed on a first layer of the plastic tile for detecting a position of the tile. The first layer further has a length-sensing line detected by an electric length-sensing eye. The printing machine further has a calculation unit capable of caculating data from the electric eyes for correcting a roller of the first layer. A code translator is fitted to a spindle of the printing roller. A feeding roller is arranged in front of the first roller, and is driven by a feeding motor. The feeding motor is controlled in respect of speed by the calculation unit to print on the first layer having preset print in a desired position after the calculation unit has received the data from the electric eyes and a turning speed datum of the printing roller from the code translator.

2 Claims, 5 Drawing Sheets

PRINTING MACHINE FOR PLASTIC TILE WITH FEEDING CORRECTION DEVICE

BACKGROUND OF THE INVENTION

A heretofore known printing machine for plastic tile with feeding correction device, referring to FIGS. 5 and 6, has electromagnetic disks 12 fitted to two ends of a first roller 11. The first roller 11 is located on a platform 13. A printed layer 14 is wound around the first roller 11, and has a central sensing line 141 and a first length sensing line 142 on tow edges. A printing roller 15 is provided at other end of the machine with a sensing device 16 arranged between it and the first roller 11. The sensing device 16 has a central electric sensing eye 161, and an electric length sensing eye 162. The printing roller 15 has a second length sensing line 151, and several inspecting points 152 in association with the length sensing line 142. The inspecting points 152 are electrically connected to an electric inspecting eye 153. The printed layer 14 is coupled to a bottom layer 17. Before the printed layer 14 is fed to the printing roller 15, both the sensing device 16 and the electric eyes 153 will get data in respect of the position and size of the print pattern. The data is then sent to memory units 181 and 182, and caculated by a computer calculation unit 183. Thus, the calculation unit 183 can control the electromagnetic disks 12 for adjusting speed of the first roller 11. Moreover, a second calculation unit 184 can also control a motor 19 for adjust the position of the platform 13 and the first roller 11. Thus, in printing on the plastic tile, the feeding speed and the position thereof in relation to the related components of the printing machine can be adjusted in the process of printing to eliminate errors.

However, it is found that the printing machine still has undesirable features as follows.

1. The electric eyes 162 and 153 are utilized to effectively sense the position and the electromagnetic disks 12 are utilized to control the feeding speed of the printed layer 14 for accurately matching the printed layer 14 and the printing roller 15. For increasing the accuracy, the plastic tile not only has to be made to have a specific size but print many length sensing lines 142 on it. There are usually 45–65 lines on it. Consequently, the material cost is relatively high.
2. Correspondingly, the printing roller 15 has to have same numbers of length sensing lines 151, and inspecting points 152. This will raise the cost. Furthermore, the electric inspecting eye 153 is difficult to install, and has high error rate.
3. The Omission and distorsion of data happen frequently because the electric eyes 153 and 162 have many points to sense. Consequently, the failure rate of products is relatively high.
4. Because the first roller 11 is pulled to move by the printing roller 15, the first roller 11 cannot be controlled in respect of feeding of the printed layer. And the fact that the plastic tile is heated in the process of printing and so lengthened is not taken into consideration. The print pattern usually has to go over tens of plastic tiles before it is finally adjusted to a proper position 2 on the plastic tile. Consequently, a worker is needed to watch in the whole process of printing in order to reduce the failure rate.

SUMMARY

The present invention relates to a printing machine for plastic tile and particularly to one which has a feeding correction device capable of adjusting a feeding roller and a printing roller in respect of position and speed to match the print of the printed layer with the print pattern of the printing roller.

The printing machine for plastic tile with feeding correction device comprises:

- a platform,
- a first roller arranged on the platform; the first roller having a first layer wound therearound,
- an electric anti-diversion eye capable of detecting an anti-diversion line on the first layer,
- an electric length-sensing line capable of detecting length sensing line on the first layer,
- a computer calculation unit, data acquired by the anti-diversion eye being sent to the computer calculation unit for calculation, the caculation unit activating a motor for adjusting the relative position between two ends of the first roller according to the data,
- a printing roller having a print pattern thereon, the printing roller being provided with a code translator on the spindle thereof,
- a feeding roller driven by a feeding motor, the calculation unit calculating data from the electric length-sensing eye and the first code translator to adjust the feeding motor in respect of the speed in order for the first layer to match the print pattern of the printing roller,
- a monitor provided for showing errors of the position of the feeding roller relative to the printing roller,
- a synchronous error correcting device provided for adjusting the position of the electric length-sensing eye when same has to be moved to be adapted for various sizes of plastic tiles,
- a second code translator fitted to the feeding roller, the second code translator providing the calculation unit with data concerning the speed of the feeding motor, the feeding motor being capable of being quickly adjusted such that same and the printing roller can run in a synchronized manner.

When the error exceeds a predetermined amount, the calculation unit will force the feeding motor to reduce the speed by 7% immediately in order to adjust same quickly.

According to experience, the circumference of the printing roller is preferrable three times the length of a signal plastic tile. The code translators can, in one revalution, produce two thousand five hundred signals, and one M starting signals that can help the computer calculation unit to produce very accurate result.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
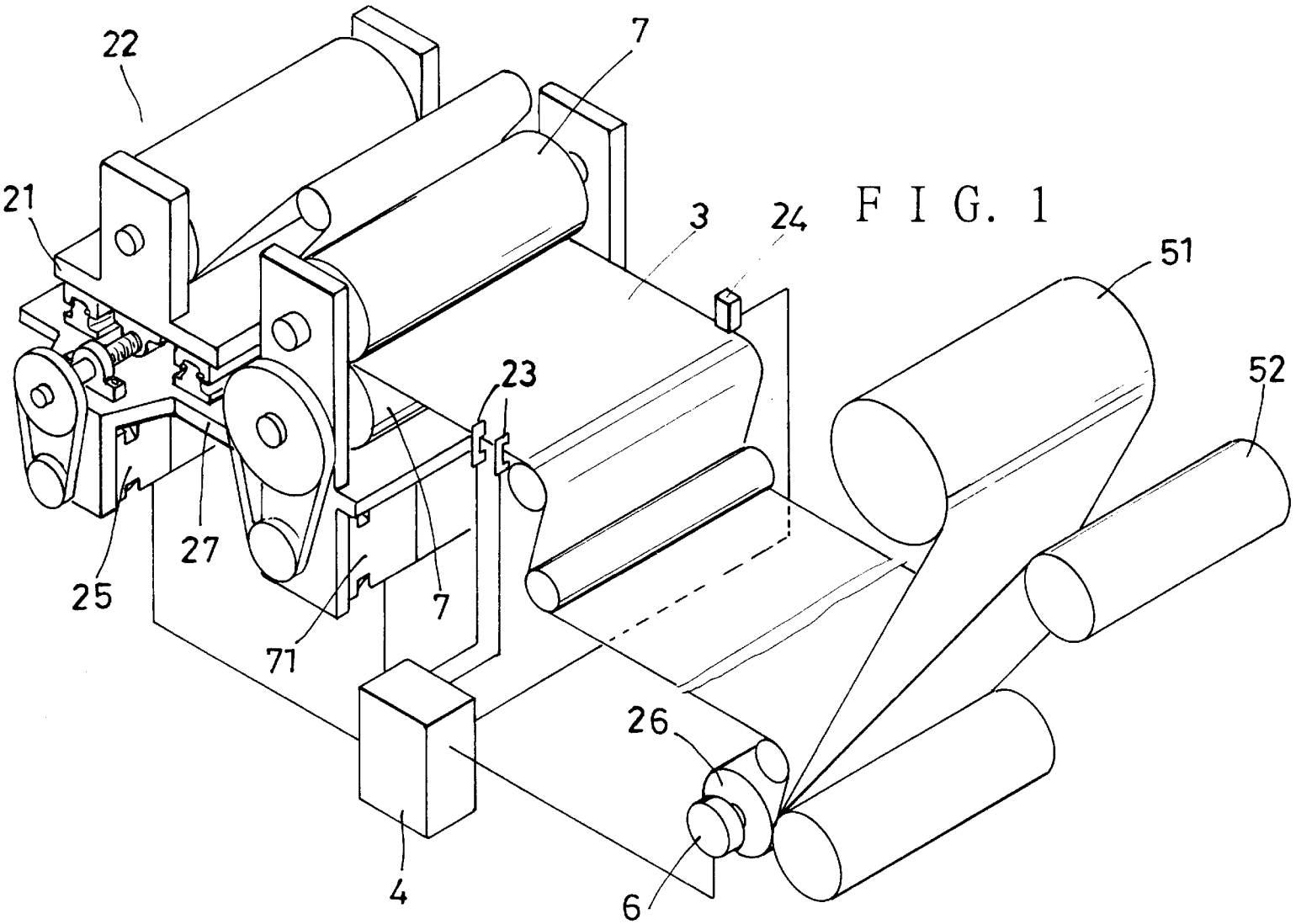
FIG. 1 is a perspective view of a printing machine for plastic tile with a feeding correction device according to the present invention.
Figure 2:
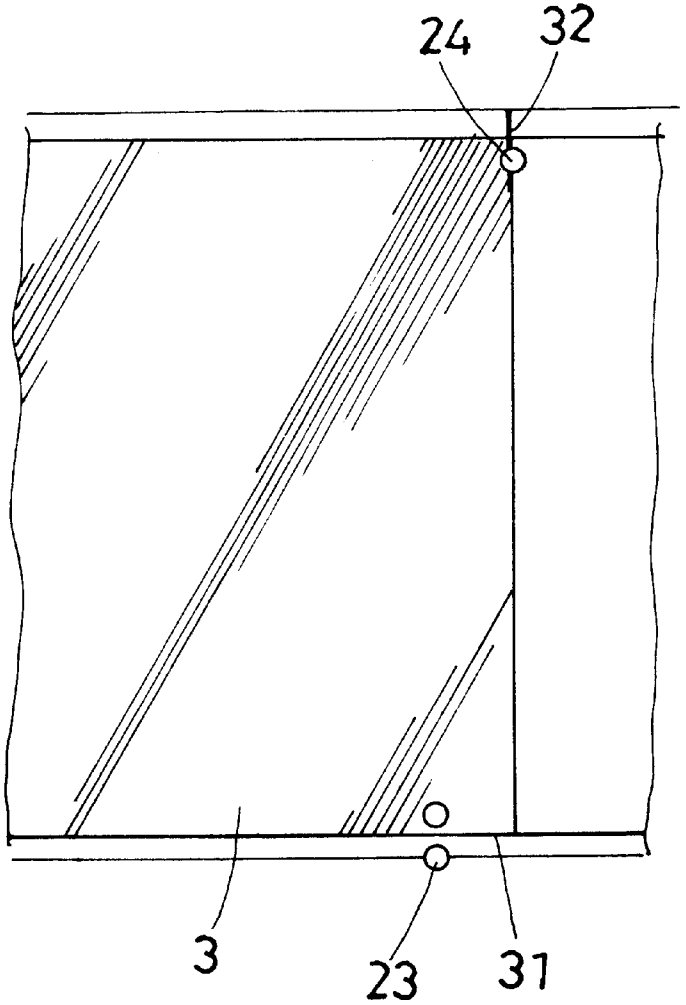
FIG. 2 is fragmentary top view of the printed layer for use in the resent invention.
Figure 3:
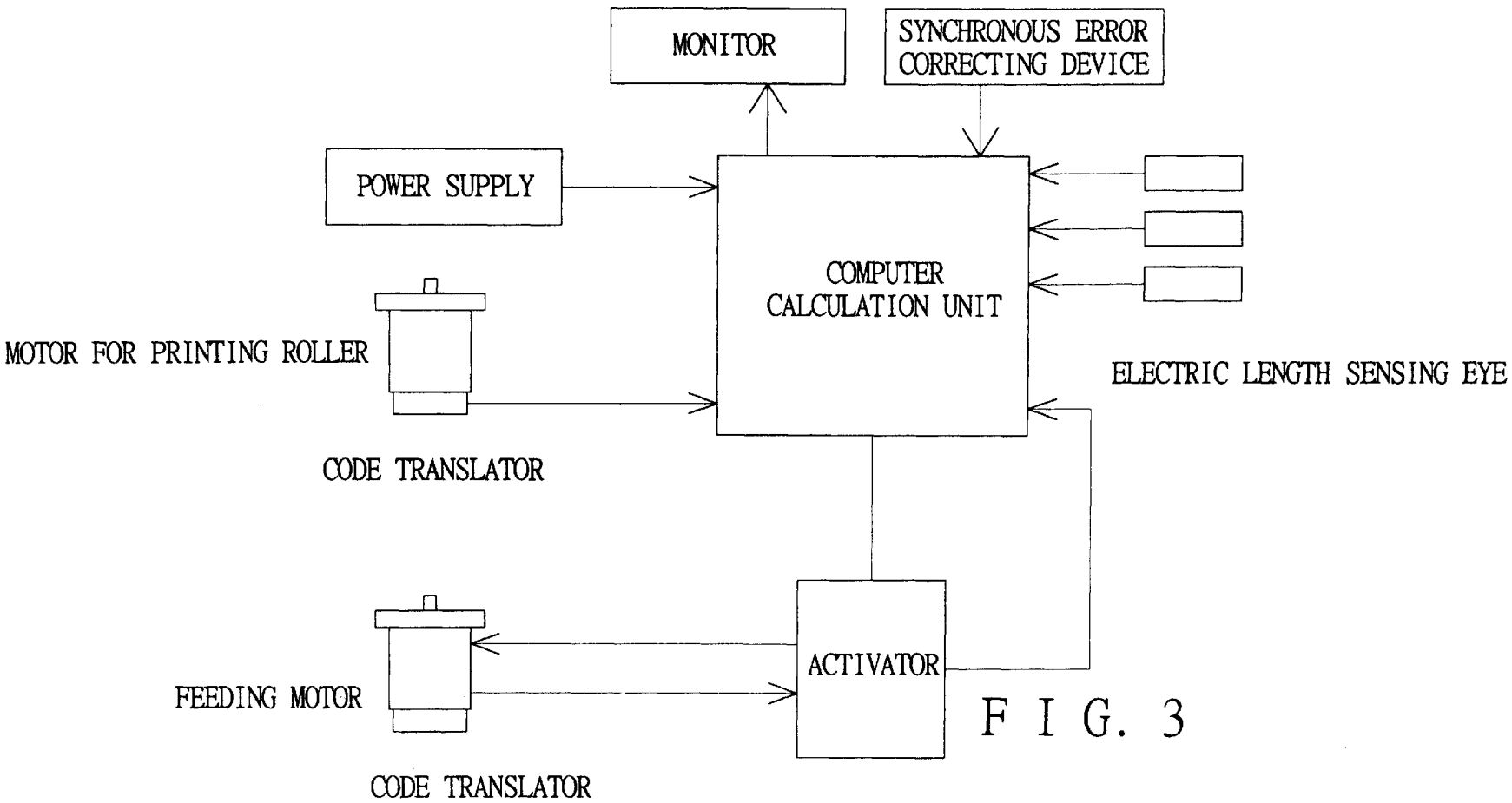
FIG. 3 is a block digram of the feeding correction device of the present invention.

Referring to FIGS. 1–3, a printing machine for plastic tile with feeding correcting device of the present invention includes a platform 21, a first roller 22, an electric anti-diversion eye 23, an electric length-sensing eye 24, a motor 25, a printing roller 26, a computer calculation unit 4, a feeding motor 71, a power supply 41, a monitor 42, a synchronous error correcting device 43, an activator 44, code translators 6 and 72. These components 4,71,41,42,43, 44, 6 and 72 are shown in FIG. 3.

The first roller 22 is arranged on the platform 21, and has a first layer 3 wound therearound. The electric anti-diversion eye 23 is provided to detect an anti-diversion line 31 of the first layer 3. The electric length-sensing line 24 detects a length sensing line 32 of the first layer 3. The data acquired by the electric anti-diversion eye 23 is sent to the computer calculation unit 4, which immediately caculates the data, and activates the motor 25 to adjust the relative position between the left and the right ends of the first roller.

The first layer 3 coupled to a second layer 51 and a third layer 52 becomes a plastic tile.

The code translator 6 is fitted to a spindle of the printing roller 26. The feeding motor 71 turns the feeding roller 7. The electric length-sensing eye 24 and the code translator 6 sends related data to the computer calculation unit 4 for calculation and comparsion, the code translator 6 being capable of getting data concerning the turning speed. Thus, the feeding motor 71 is properly controlled in respect of speed in order to match a print of the first layer 3 with a print pattern of the printing roller 26.

Referring to FIG. 3, the power supply 41 is connected to the computer calculation unit 41 for supplying same with power. The monitor 42 is provided to show errors of the position of the feeding roller 7 and the printing roller 26. The synchronous error correcting device 43 is provided for adjusting a position of the electric length-sensing eye 24 when the electric eye 24 has to be moved to be adapted for various sizes of plastic tiles; earlier similar printing machine does not have a synchronous error correcting device, so a worker has to move the electric eye 24 manually. When the electric length-sensing eye 24 is not located at a proper position, a correction value is given to the synchronous error unit 43 to adjust the data from the code translator 72 of the feeding roller 7 in order to quickly adjust the feeding speeding of the feeding motor 71.

The computer calculation unit 4 calculates the data from both the code translator 6 and the electric length-sensing eye 24, and activates the feeding motor 71 through the activator 44 according to the calculation outcome. The code translator 72 sends the data concerning the speed of the feeding motor 71 meanwhile, to the computer calculation unit 4. Thus, feeding motor 71 can be very quickly adjusted such that same and the printing roller 26 can run in a synchronized manner. According to experience in using the prior art printing machine, it takes twenty-five to fourty unsuccessful products before the feeding motor 71 and the printing roller 26 can run properly.

There are two main reasons for the unsucessful products: (1) the print on the printed layer 3 is not clear, and (2) the printed layer 3 is lengthened when treated. In the present invention, when the error exceeds a predetermined value, the computer calculation unit 4 will force the feeding motor 71 to reduce the speed by 7% immediately in order to adjust same quickly.

The reason why the code translators 6 and 72 are provided is that the code translators can, in one revolution, produce two thousand five hundred signals, and one M starting signal which can help the computer calculation unit to produce very accurate results.

According to experiment, the circumference of the printing roller 26 must equal a length of a signal plastic tile multipled by an integer. And, it is preferrably three times the length of a tile. The data concerning the speed and position of the printing roller 26 is available with the help of the signals of the code translators 6, 72 and the ratio of the circumference of the printing roller 26 to the length of the tile.

Referring to FIG. 2, the length sensing line 32 only has to be provided on the front end portion of the print of every tile because the computer calculation unit 4 can read eight hundred and thirty three signals between every two adjacent length sensing lines 32.

The reason why the feeding roller 7 is forced to reduce the speed by 7% when same and the related components do not work together in a proper manner as above said is that the heated and unwantingly lengthened printed layer 3 will be further lengthened by reducing speed of the feeding motor 71, making the related components to recover the proper working manner as above said. It is inevitable that unsuccessful products will be made in the adjusting process. However, the number of the unsuccessful products can be greatly reduced to fourteen. It is preferrably 7% and not over because if the speed of the feeding roller is reduced for more than 7%, the printed layer is likely to break from the heated point.

Figure 4:
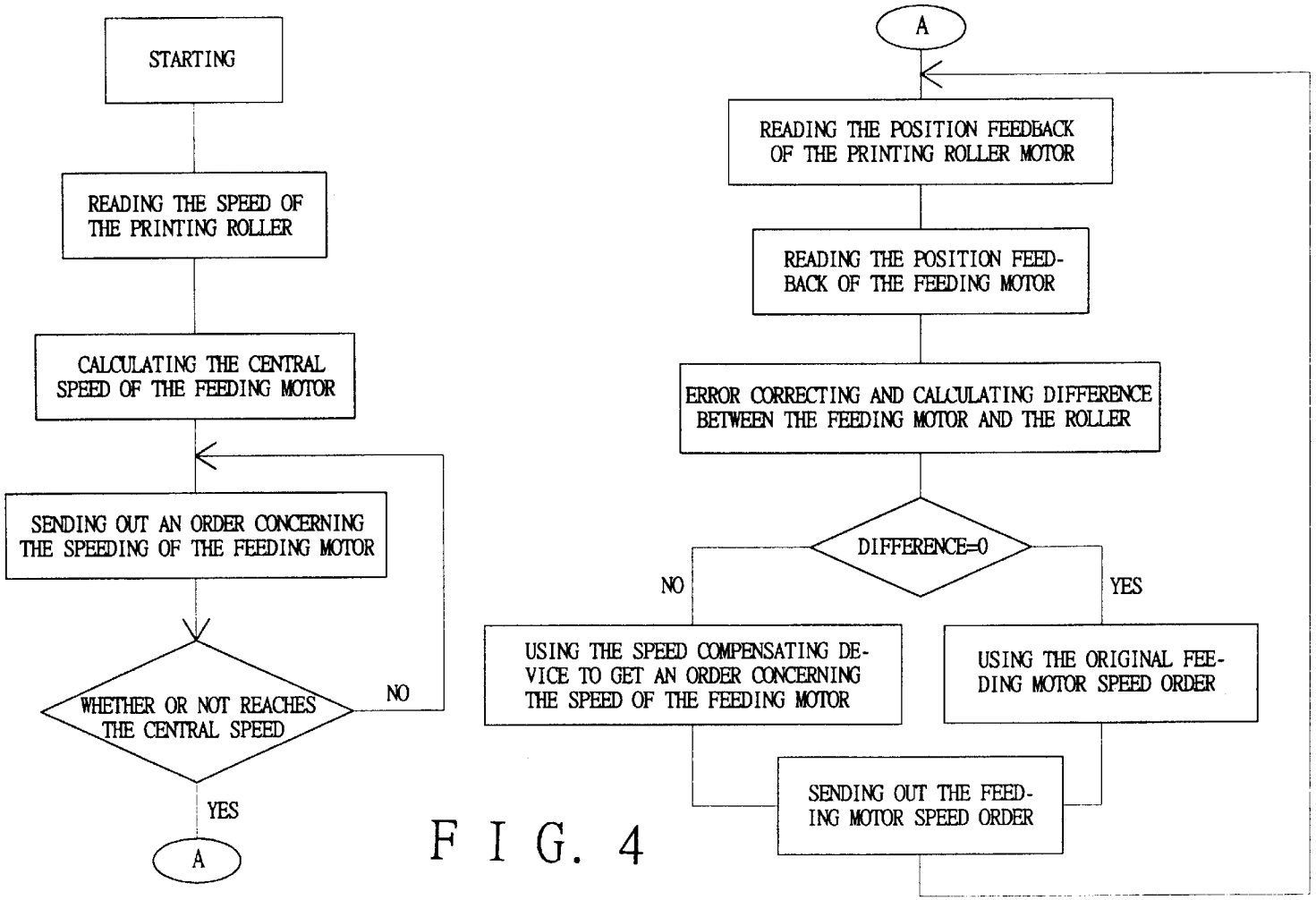
FIG. 4 is a flow chart of the feeding correction process according to the present invention.
Figure 5:
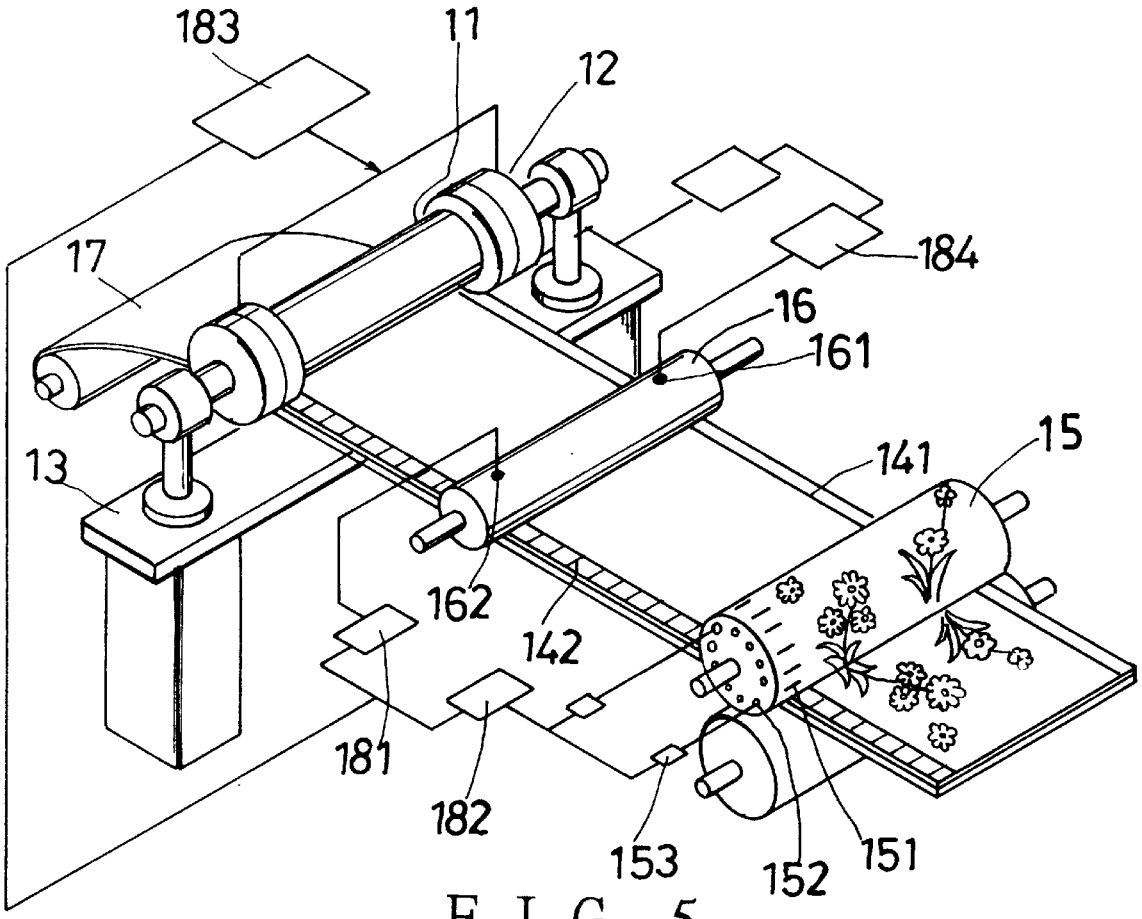
F I G. 5 (PRIOR ART)
FIG. 5 is a view of a conventional printing machine for plastic tile with feeding correction device according to the Background.
Figure 6:
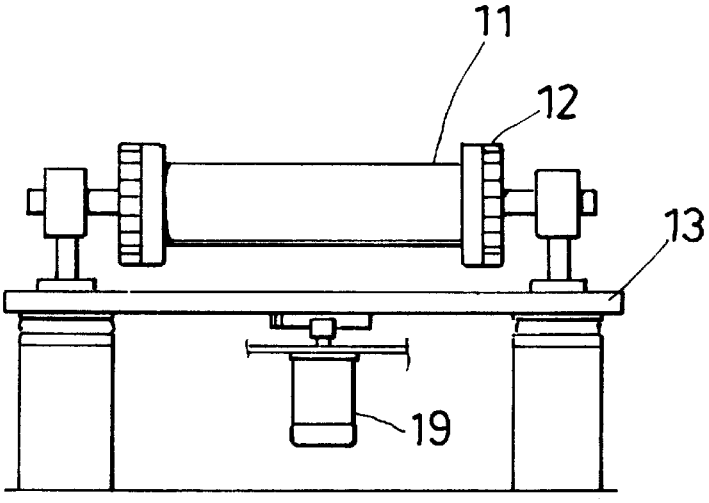
F I G. 6 (PRIOR ART)
FIG. 6 is a front view of the printing machine in FIG. 5.

Referring to FIGS. 3 and 4, the calculation unit 4 can calculate the position and the turning speed of the printing roller 26 according to the facts that the circumference of the printing roller equals three times the length of a single tile and that the two thousand five hundred signals are divided into three equal cycles, and that there is an M starting signal.

Furthermore, the feeding motor uses toothed belts to turn the feeding roller; according to the number of the teeth of the belt and the circumference of the feeding roller, we can known the length of the printed layer is fed in every single feed-back signal. In using the printing machine, the calculation unit 4 will first work according to the feedback signal of the printing roller, and the feeding motor will also send the feed-back signal to the calculation unit for comparsion. Thus, the calculation can gradually make the feeding roller and the printing roller work in a synchronized manner. The calculation unit receives the feed-backs signals from both the printing roller 26 and the feeding roller 7, and the electric length sensing eye 24 gives the data concerning the position of the plastic tile; the code translator of the feeding roller 7 proceeds with the error correction; the calculation unit 4 caculates the difference between the feed-back signals of both the feeding roller 7 and the printing roller 26 with a speed compensating device thereof after the feeding roller has been corrected. When the difference is smaller than a predeterminded amount, the speed-compensating device of the calculation unit will make some adjustment or do nothing. When the difference is more than the predeterminded amount, the speed-compensating device will make the feeding motor 7 to reduce the speed by 7%.

From the above description, it can be understood that the printing machine for plastic tile with feeding correction device of the present invention has desirable features as follows.

1. The printing roller is provided with a code translator having two thousand and five hundred signals and one M starting signals, capable of accurately controlling the speed of the feeding roller.

2. The printed layer does not have to have forty five to sity five length sensing lines as in the prior art printing machine, and needs only a length sensing line at a starting point of the print thereof because of the two thousand and five hundred signals of the code translator.

3. The code translator can be fitted to the printing roller very easily, and can be used in printing rollers of various sizes. Furthermore, the code translator does not have possibility of signal ommission or distortion.

4.The feeding speed of the printed layer is controlled by the feeding roller, which can be quickly and accurately adjusted to work properly together with the printing roller. And, the feeding motor can turn at a constant speed after same is adjusted to properly work together with the printing roller.

5. When the difference between the feed-back signals of both the feeding roller and the printing roller exceeds a predetermined amount, the speed of the feeding roller is forced to reduce by 7%. Thus, the proper working condition can be quickly restored before too many unsuccessful products are made.

6. The computer calculation unit is provided with a synchronous error-correcting device, which can correct errors that might be still present when the desired synchronized working condition is reached.

What is claimed is:

1. A printing machine for plastic tile, comprising:

a laterally displaceable platform supporting a first roller carrying a supply of a plastic layer thereon;

a control motor coupled to said platform for displacing said platform responsive to a first drive signal;

a printing roller longitudinally spaced from said first roller and driven by a motor for printing on the plastic layer;

a feeding roller disposed between said first roller and said printing roller for longitudinally feeding the plastic layer to the printing roller;

a feeding roller motor drivingly coupled to said feeding roller for rotating said feeding roller responsive to a second drive signal;

a first sensor disposed in proximity to a portion of the plastic layer for detecting a longitudinally extended marking on said plastic layer portion;

a second sensor disposed between said feeding roller and said printing roller for detecting a length sensing line formed on the plastic layer;

a first code translator mounted to said printing roller for establishing output signals corresponding to a rotational speed of said printing roller;

a second code translator mounted to said feeding roller motor for establishing output signals corresponding to a rotational speed of said feeding roller motor;

a computer calculation unit having a plurality of inputs coupled respectively to (a) said first sensor, (b) said second sensor, (c) said first code translator, and (d) said second code translator, said computer calculation unit including means for maintaining a lateral position of the plastic layer responsive to signals from said first sensor, said lateral position maintaining means generating said first drive signal output to said control motor, said computer calculation unit including means for controlling the rotational speed of said feeding roller motor to be in synchronization with the rotational speed of said printing roller, said rotational speed controlling means outputting said second drive signal to said feeding roller motor responsive to input signals from said second sensor, said first code translator and said second code translator, said rotational speed controlling means including means for reducing said rotational speed of said feeding roller motor by 7% responsive to a difference in speed between said feeding roller motor and said printing roller exceeding a predetermined amount and then adjusting said feeding roller motor speed to provide said synchronization; and, a synchronous error unit coupled to said computer calculation unit for adjusting said output signals from said second code translator to automatically compensate for a mis-location of said second sensor and thereby decrease a time period required to synchronize said feeding roller motor with said printing roller.

2. The printing machine as recited in claim 1 where said first code translator produces two thousand five hundred output signals per revolution of said printing roller that are transmitted to said computer calculation unit and said second code translator produces two thousand five hundred output signals per revolution of said feeding roller motor that are transmitted to said computer calculation unit, whereby said synchronization is performed highly accurately.

* * * * *